US011365109B2

(12) United States Patent
Park

(10) Patent No.: US 11,365,109 B2
(45) Date of Patent: Jun. 21, 2022

(54) METHOD OF CONTROLLING ARTIFICIAL INTELLIGENT LIQUID DISPENSING APPARATUS

(71) Applicant: LG ELECTRONICS INC., Seoul (KR)

(72) Inventor: Shinhyun Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/232,663

(22) Filed: Apr. 16, 2021

(65) Prior Publication Data

US 2021/0229974 A1 Jul. 29, 2021

Related U.S. Application Data

(63) Continuation of application No. 16/502,942, filed on Jul. 3, 2019, now Pat. No. 11,008,207.

(30) Foreign Application Priority Data

Jul. 17, 2018 (KR) ..... 10-2018-0083060

(51) Int. Cl.

| | |
|---|---|
| ***B67D 1/08*** | (2006.01) |
| ***F25D 29/00*** | (2006.01) |
| ***F25D 23/12*** | (2006.01) |

(52) U.S. Cl.

CPC ..... *B67D 1/0888* (2013.01); *B67D 1/0878* (2013.01); *F25D 23/126* (2013.01); *F25D 29/00* (2013.01)

(58) Field of Classification Search

CPC ..... B67D 1/0878; B67D 1/0888; B67D 3/0003; B67D 3/0009; B67D 3/0012; F25D 23/126; F25D 29/00

See application file for complete search history.

(56) References Cited

U.S. PATENT DOCUMENTS 6,317,717 B1 * 11/2001 Lindsey ..... E03C 1/055 137/559
7,369,395 B2 5/2008 Togashi
(Continued)

FOREIGN PATENT DOCUMENTS

CN 101416840 4/2009
CN 103016814 4/2013
(Continued)

OTHER PUBLICATIONS

Korean Notice of Allowance dated Dec. 31, 2019 issued in KR Application No. 10-2018-0083060.
(Continued)

*Primary Examiner* — Timothy L Maust
(74) *Attorney, Agent, or Firm* — KED & Associates LLP

(57) ABSTRACT

The present invention relates to a water dispensing device control method, which includes: a step of allowing a call word in a sound shape uttered from a user to be input into a microphone; a step of identifying the input call word in a sound identifying module and outputting guiding sound of identifying the call word through a speaker; a step of allowing the desired discharge water amount in the sound shape uttered from the user to be input into the microphone; a step of identifying the input desired water discharge amount in the sound identifying module and outputting guiding sound of identifying the water discharge amount through the speaker; a step of allowing a user to input a water discharge order; a step of allowing water discharge to be implemented while a water discharge valve is opened; and a step of allowing the water discharge to be finished while the water discharge valve is closed when the water discharge flow rate detected in a flow rate sensor reaches the input desired water discharge amount.

20 Claims, 8 Drawing Sheets

(56) References Cited

U.S. PATENT DOCUMENTS

| | | | | |
|---|---|---|---|---|
| 7,690,395 | B2 ‡ | 4/2010 | Jonte | E03C 1/057 137/624.11 |
| 8,572,772 | B2 * | 11/2013 | Wolf | E03C 1/057 4/623 |
| 9,010,580 | B2 ‡ | 4/2015 | Rolek | F25D 23/126 222/146.6 |
| 9,164,518 | B2 ‡ | 10/2015 | Houghton | G05D 23/1393 |
| 9,458,612 | B2 ‡ | 10/2016 | Thomas | E03C 1/057 |
| 9,638,461 | B2 * | 5/2017 | Wait | F25D 23/126 |
| 10,121,306 | B2 ‡ | 11/2018 | Peters | G07F 11/00 |
| 10,448,762 | B2 ‡ | 10/2019 | Murphy | E03D 9/002 |
| 10,458,642 | B2 ‡ | 10/2019 | Heuer | E03C 1/0404 |
| 10,663,938 | B2 ‡ | 5/2020 | Rexach | G01N 35/00871 |
| 10,676,339 | B2 ‡ | 6/2020 | Karol | B67D 1/1247 |
| 2007/0246550 | A1 ‡ | 10/2007 | Rodenbeck | G05D 23/1353 236/12.11 |
| 2008/0083893 | A1 ‡ | 4/2008 | Rubenstein | G10L 15/26 251/129.04 |
| 2008/0271238 | A1 ‡ | 11/2008 | Reeder | A46B 7/04 4/597 |
| 2009/0056011 | A1 ‡ | 3/2009 | Wolf | E03C 1/057 4/623 |
| 2010/0200789 | A1 ‡ | 8/2010 | Connors | F16K 51/00 251/129.04 |
| 2015/0329347 | A1 ‡ | 11/2015 | Veldhi | B67D 3/0003 141/1 |
| 2017/0160119 | A1 ‡ | 6/2017 | Outlaw | G06Q 10/30 |

FOREIGN PATENT DOCUMENTS

| | | |
|---|---|---|
| CN | 206261451 | 6/2017 |
| CN | 107232983 | 10/2017 |
| KR | 10-1999-0030565 | 5/1999 |
| KR | 10-2008-0096239 | 10/2008 |
| KR | 10-2010-0091633 | 8/2010 |
| KR | 10-2014-0070270 | 6/2014 |
| KR | 10-2015-0039949 | 4/2015 |
| KR | 10-2017-0072064 | 6/2017 |

OTHER PUBLICATIONS

Chinese Office Action dated Jan. 19, 2021 issued in CN Application No. 201910489728.8.

Korean Office Action dated Jul. 31, 2021 issued in Application No. 10-2021-0040166.

* cited by examiner

‡ imported from a related application

METHOD OF CONTROLLING ARTIFICIAL INTELLIGENT LIQUID DISPENSING APPARATUS

CROSS-REFERENCE TO RELATED APPLICATIONS

The present application is a Continuation of U.S. application Ser. No. 16/502,942, filed Jul. 3, 2019, which claims priority under 35 U.S.C. 119 and 35 U.S.C. 365 to Korean Patent Application No. 10-2018-0083060, filed in Korea on Jul. 17, 2018, whose entire disclosures are hereby incorporated by reference.

BACKGROUND

1. Field

The present specification relates to a method of controlling a water dispensing apparatus.

2. Background

Various devices may dispense water. For example, a water purifier or a refrigerator may use various chemical and/or physical filtration methods to treat water supplied from a water source, such as a well or a water utility, to remove impurities and supply the filtered water. For example, a water dispenser may be classified into a nature filtering type, a direct filtering type, an ion exchange resin type, a distillation type, a reverse osmosis type, etc. according to the purification principle or method.

In a water dispensing apparatus, a cup or container to receive water (or other liquid) is typically placed below a water discharge nozzle, and water is supplied when a user presses a water supply or discharge button. When the user determines that a desired amount of water is supplied, the user stops pressing the button to stop the supply of water. Therefore, the user needs to continuously check the amount of water until the desired amount of water is discharged. When the user is distracted or miscalculates the amount of discharged water, the user may be slow to stop pressing the discharge button such that an excess amount of water is discharged and water overflows the user's container. When hot water is being discharged, a user's hand may be burned.

Certain types of water dispensing apparatus may have an auto water discharge button to discharge a predetermined amount of water. However, the amount of water discharged by pressing the automatic water discharge button once is typically small (e.g., 50 ml) and unrelated to a size of a user's container. Therefore, in order to fill a large cup with water, the user may need to press the automatic water discharge button several times, such as pressing the above-described automatic water discharge button for 50 ml ten times to fill a large cup with 500 ml of water. Although the preset discharge amount may be adjusted, this manual adjustment may be burdensome and would need to be repeatedly performed to adjust for different containers.

BRIEF DESCRIPTION OF THE DRAWINGS

Embodiments will be described in detail with reference to the following drawings in which like reference numerals refer to like elements and, wherein.

DETAILED DESCRIPTION

Figure 1:
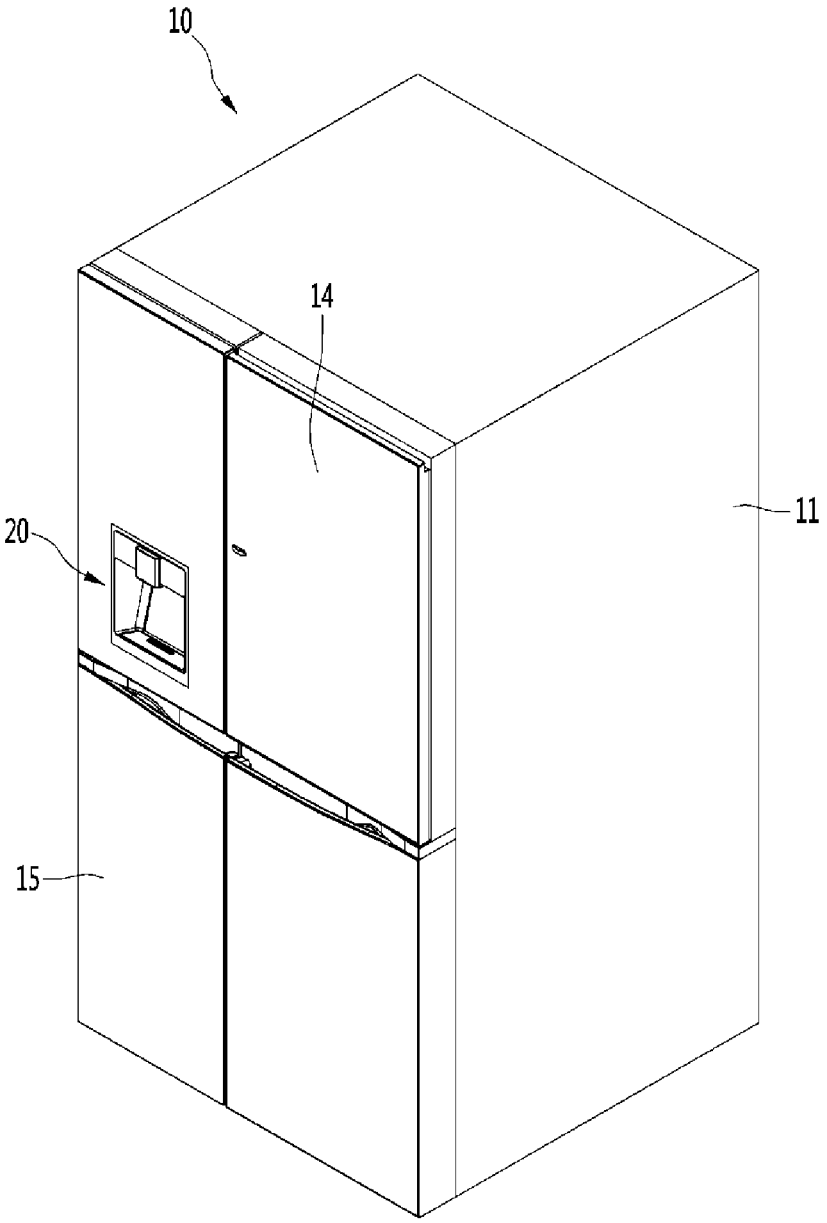
FIG. 1 is a perspective view of a water dispensing apparatus according to an embodiment of the present disclosure.

Hereinafter, the embodiments of the present disclosure will be described in detail with reference to the accompanying drawings. It is noted that reference numerals are used to designate identical or similar elements throughout the several views. In describing the present disclosure, if it is determined that the detailed description of a related known function or construction renders the scope of the present disclosure unnecessarily ambiguous, the detailed description thereof will be omitted.

Figure 2:
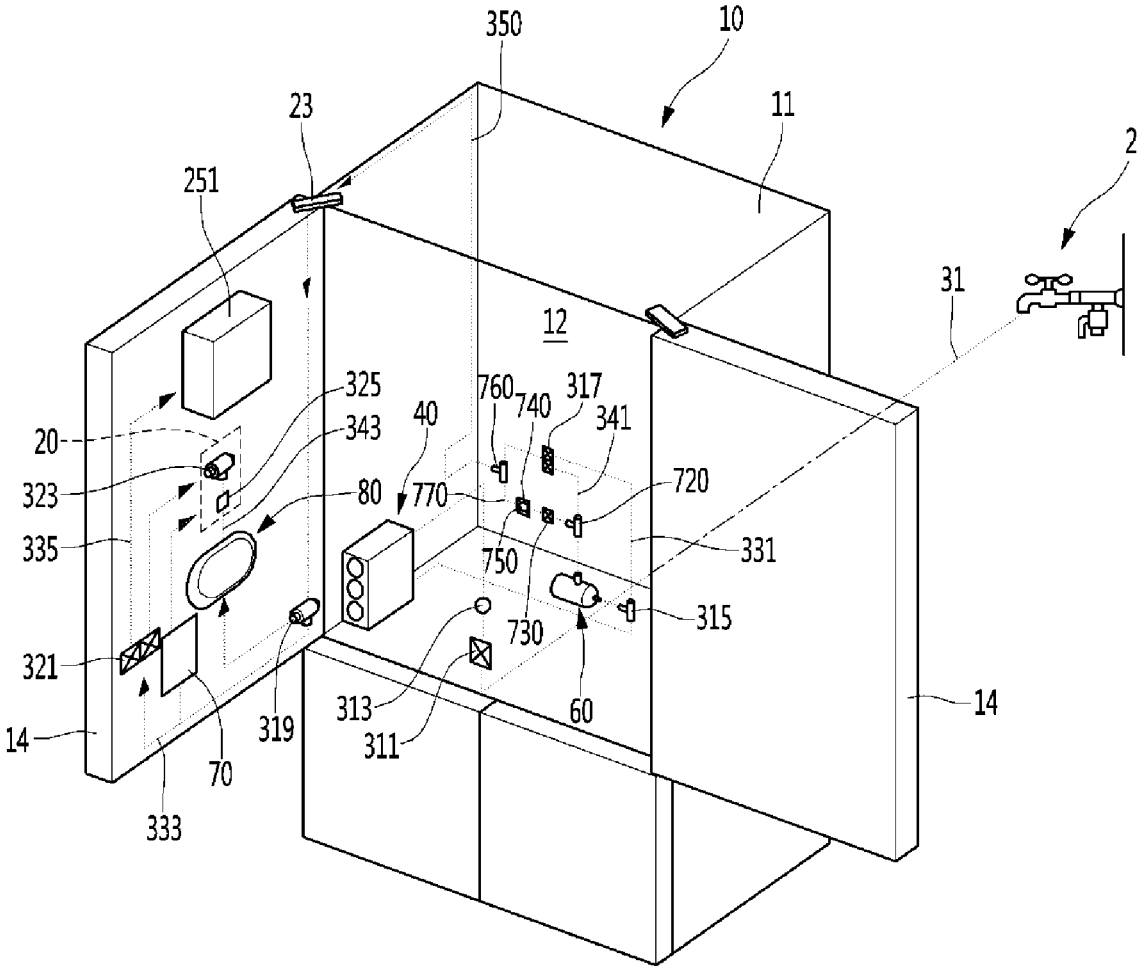
FIG. 2 is a schematic view showing arrangement of flow passages, in which water flows, in a water dispensing apparatus according to an embodiment of the present disclosure.
Figure 3:
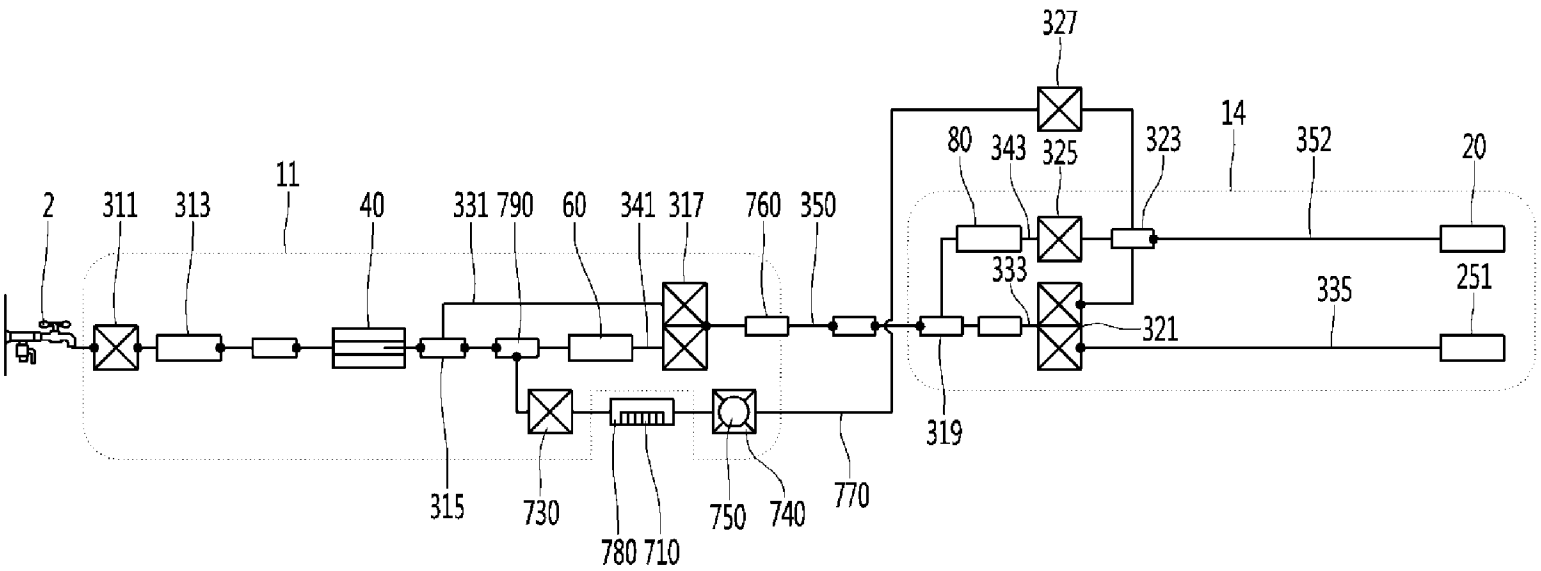
FIG. 3 is a view showing water pipes in a water dispensing apparatus according to an embodiment of the present disclosure.

FIG. 1 is a perspective view of a water dispensing apparatus according to an embodiment of the present disclosure, FIG. 2 is a schematic view showing arrangement of flow passages, in which water flows, in a water dispensing apparatus according to an embodiment of the present disclosure, and FIG. 3 is a view showing water pipes in a water dispensing apparatus according to an embodiment of the present disclosure.

Referring to FIGS. 1 to 3, the water dispensing apparatus (or water dispenser) 10 according to one embodiment of the present disclosure may be a refrigerator (in the following discussion the terms water dispensing apparatus 10 and refrigerator 10 will be used interchangeably). Although the water dispensing apparatus of the present disclosure is described as the refrigerator 10 in the following description, the present disclosure is not limited thereto, and the water dispensing apparatus according to other aspects of the present disclosure may be a separate water purifier or other liquid dispensing device.

In one example, the refrigerator 10 may include a cabinet 11 forming a storage space and one or more doors 14 and 15 for opening and closing the storage space of the cabinet 10. The storage space may include a refrigerating compartment 12 and/or a freezing compartment (not shown). For example, the doors 14 and 15 may include the refrigerating compartment door 14 for opening and closing the refrigerating compartment 12 and the freezing compartment door 15 for opening and closing the freezing compartment.

The refrigerating compartment door 14 and the freezing compartment door 15 may rotate to open and close, respectively, the refrigerating compartment 12 and the freezing compartment. For example, the refrigerating compartment door 14 and the freezing compartment door 15 may be rotatably connected to the cabinet 10 by at least one hinge device 23. In addition, at least one of the refrigerating compartment door 14 or freezing compartment door 15 may be French-type doors in which a pair of doors is configured to independently rotate on left and right sides, as shown in FIGS. 1 and 2.

In one implementation, a dispenser 20 and an ice maker 251 may be provided in any one of the pair of the refrigerating compartment doors 14. It should be appreciated that at least one of the dispenser 20 or the ice maker 251 may be provided in another section of the refrigerator 10.

The dispenser 20 may be provided on a front surface of refrigerating compartment door 14 to discharge one or more of water or ice when a user operates the dispenser 20. In addition, an icehouse (e.g., a separate freezer compartment) may be provided above the dispenser 20, and the ice maker 251 may be accommodated in the icehouse. For example, the icehouse may be opened and closed by a separate door. In addition, although not shown, the icehouse may communicate with the freezing compartment by a cold-air duct in through the refrigerating compartment door 14, thereby receiving cold air to make ice from a freezing compartment evaporator (not shown).

The refrigerator 10 allows water supplied from an external water source 2 or other liquid to be discharged from the dispenser 20. For example, the dispensed liquid may be discharged after being purified, cooled or heated. The refrigerator 10 may be connected to the water source 2 by a water supply flow passage 31. The refrigerator 10 may further include a water introduction valve 311 provided in the water supply flow passage 31 and a main-body amount-of-introduced-water sensor 313. Supply of raw water from the water source 2 may be controlled by opening and closing the water introduction valve 311.

The main-body amount-of-introduced-water sensor 313 may measure the amount of water supplied from the water source 2. In another example, the amount-of-introduced-water sensor 313 may be configured integrally with the water introduction valve 311. The water introduction valve 311 may be provided on a rear surface of the cabinet 10 or in a machine room in which a compressor is provided. Alternatively, the main-body amount-of-introduced-water sensor 313 may be positioned away from the water supply flow passage and downstream (e.g., in an inlet to the dispenser 20) to measure the amount of discharged cold water or purified water.

The refrigerator 10 may further include a purifying device (or purifier) 40 for purifying water supplied from the water source 2. The purifying device 40 may include one or more filters for purifying supplied water. The plurality of filters may be vertically stacked in the refrigerating compartment 12, for example. By vertically stacking the plurality of filters, the space of the refrigerating compartment 12 may be efficiently used. In addition, even if water leakage occurs in the purifying device 40, vertically stacking the plurality of filters allows the purifying device 40 to be relatively small in a horizontal direction such that only a narrow area in the refrigerating compartment 12 may be contaminated, thereby configuring the refrigerating compartment 12 to be an efficient and safe space.

In an embodiment of the present disclosure, the purifying device 40 may include three filters. For example, the plurality of filter may include a pre-carbon filter, a post-carbon filter and a membrane filter disposed between the pre-carbon filter and the post-carbon filter. Of course, the number and type of filters are not limited, but different types of functional filers may be applied in consideration of the number of filters accommodatable in the purifying device 40 and efficient water purification.

The refrigerator 10 may further include a first branching part (or first branch or tee) 315 provided at the outlet side of the purifying device 40, a main-body cold-water flow passage 341 connected to a first branch of the first branching part 315 and a main-body purified-water flow passage 331 connected to a second branch of the first branching part 315.

Accordingly, water discharged from the purifying device 40 may flow into the main-body cold-water flow passage 341 and a main-body purified-water flow passage 331 by the first branching part 315. The main-body cold-water flow passage 341 may be provided with a main-body water tank 60. The main-body water tank 60 may be formed in a cylindrical shape, for example, and may be located in the refrigerating compartment 12.

The refrigerator 10 may further include a main-body valve 317 connected with the main-body cold-water flow passage 341 and the main-body purified-water flow passage 331, and a common flow passage 350 connected to the outlet side of the main-body valve 317. The main-body valve 317 may include two inlets and one outlet, for example. The main-body purified-water flow passage 331 and the main-body cold-water flow passage 341 may be respectively connected to the two inlets, and the common flow passage 350 may be connected to the outlet. The common flow passage 350 may be drawn out from an inner case forming the refrigerating compartment 12 and may be introduced into the refrigerating compartment door 14 through the hinge device 23 of the refrigerating compartment door 14 along the outside of the cabinet 10.

The refrigerator 10 may further include a second branching part (or second branch or tee) 319 connected to the common flow passage 350 introduced into the refrigerating compartment door 14, a door purified-water flow passage 333 connected to the second branching part 319, and a door cold-water flow passage 343 connected to the second branching part 319.

The refrigerator 10 may further include a door water tank 80 provided in the door cold-water flow passage 343 and a cold-water valve 325 located on the door cold-water flow passage 343 at the outlet side of the door water tank 80. The door water tank 80 may cool water cooled and suppled in the main-body water tank 60 again. When water cooled in the main-body water tank 60 flows along the common flow passage 350 and passes through the outside of the cabinet 10, the temperature of water may be increased. Accordingly, the door water tank 80 may cool water with the increased temperature again such that cold water having a target water temperature is discharged.

In particular, when water is first discharged when the cold water has not been discharged for a long time (e.g., more than a threshold length of time), the temperature of water remaining in the common flow passage 350 outside the refrigerating compartment 12 for a long time may be increased such that the temperature of discharged water may not be sufficiently cold or warm. However, by additional cooling and mixing of cooled water in the door water tank 80, the temperature of discharged water may be adjusted to achieve a desired level.

The refrigerator 10 may further include a purified-water valve 321 provided in the door purified-water flow passage 333 and an ice making flow passage 335 connected to the purified-water valve 321. Purified water flowing along the door purified-water flow passage 333 may be discharged from the dispenser 20 by the purified-water valve 321 or may be supplied to the ice maker 251 along the ice making flow passage 335.

The refrigerator 10 may further include a door connector 323 connected with the door purified-water flow passage 333 and the door cold-water flow passage 343, and a discharge flow passage 352 connected to the door connector 323. Cold water and purified water may be discharged from the dispenser 20 along the discharge flow passage 352.

The door connector 323 may include two inlets and one outlet. The door purified-water flow passage 333 and the door cold-water flow passage 343 may be respectively connected to the two inlets and the discharge flow passage 352 may be connected to the outlet.

The purified-water valve 321 may be a three-way valve for controlling the flow direction of purified water. Accordingly, in order to discharge cold water, the cold water valve 325 may be opened in a state of closing the purified-water valve 321. In order to discharge purified water, the purified-water valve 321 may be opened in a state of closing the cold water valve 325 and the purified-water valve 321 may switch the flow passage such that purified water flows in the discharge flow passage 352.

In one implementation, the refrigerator 10 may include a hot water flow passage 770 for guiding purified water filtered by the filter device 40 to the dispenser 20 while bypassing the water tank 60, a hot water introduction valve 730 provided in the hot water flow passage 770, a hot water tank 780 provided on the hot water flow passage 770, a heater 710 for heating water stored in the hot water tank 780, a hot-water temperature sensor 750 provided on the hot water flow passage 770, a hot-water amount control valve 740 provided on the hot water flow passage 770, and a hot water discharge valve 327 for controlling discharge of hot water. Accordingly, hot water of the hot water tank 780 heated by the heater 710 may be supplied to the dispenser 20.

In various embodiments, the heater 710 may heat water stored in the hot water tank 780. For example, the hot water tank 780 may be formed of a metal material and, more particularly, a stainless steel material, and the heater 710 may heat the hot water tank 780 using an inductive heating method. In another example, the heater 710 may be a surface heating element that is coupled to or otherwise positioned to apply heat to the hot water tank 780.

In addition, in the present embodiment, the hot water tank 780 may be disposed outside the storage space. For example, the hot water tank 780 may be disposed outside the refrigerator, and water stored in the hot water tank 780 may not be cooled by cold air of the storage space and may have a temperature similar to a room temperature. In this case, water stored in the hot water tank 780 is not cooled. Accordingly, when hot water is generated, heating may be immediately performed without discharging water stored in the hot water tank 780. Accordingly, it is possible to preserve water and to reduce heat energy used to generate hot water to improve heat efficiency.

In addition, when the hot water tank 78 is placed outside the refrigerator as described above, the heater 710 may be placed outside the refrigerator. Since heat generated in the heater 710 does not affect the internal temperature of the refrigerator, it is possible to improve efficiency of the refrigerator as compared to the case where the heater 710 is provided inside the refrigerator.

Hereinafter, a process of generating and discharging hot water in the refrigerator having the hot water tank 780 disposed at the outside thereof will be described. First, when a hot water discharge command is received from the door side, the hot water valve 730 is opened, and the water introduction valve 311 is opened. By opening the water introduction valve 311, water of the water source 2 may be introduced into the water supply flow passage 31 and may be supplied to the filter device 40.

Purified water filtered by the filter device 40 may be transferred to the hot water flow passage 770 by sequentially passing through the first branching part 315 and the third branching part 790. Purified water transferred to the hot water flow passage 770 may be stored in the hot water tank 780 after passing through the hot water valve 730.

At this time, when the heater 710 operates, purified water stored in the hot water tank 780 may be heated to generate hot water, and hot water may be discharged to the dispenser 20 after passing through the hot water discharge valve 327, the door connector 323, and the discharge flow passage 352.

The above-described water dispensing apparatus 10 may include a water discharge button. Accordingly, when a user presses the water discharge button, a predetermined amount of water is discharged. However, since the size and shape of a cup is not considered, the amount of water discharged by pressing the water discharge button once may be relatively small. Therefore, in order to fill a large cup with water, a user may be required to press the water discharge button several times.

For example, when the set amount of the discharged water is 50 ml, water of 50 ml is discharged each time the user presses the water discharge button. However, since only the set amount of water is supplied regardless of the size and height of the cup, in order to fill a large cup with 500 ml of water, a user would need to repeatedly press the water discharge button (e.g., 10 times). Thus, the user may need to provide multiple repeated inputs to receive a desired amount of liquid In addition, to discharge water in an amount that differs from the set amount of water, a user would operate a first button (or other input device) for controlling the amount of discharged water (e.g., to modify the set amount of the discharged water to a desired level) and operate a second button (or other input device) for initiating the water discharge. Thus, the user may need to provide multiple different inputs to receive a desired amount of liquid. Thus, a user would generate operate the one or more buttons multiple times in order to discharge a large amount of water or to accurately control the amount of discharged water.

In addition, to discharge an amount hot water or cold water, the user would selectively operate a hot water button or a cold water button for selecting a temperature of water and to secondarily operate one or more water discharge buttons for instructing water discharge and to set an amount of the hot or cold water to discharge. Thus, a user would perform button operation to receive a desired amount of hot or cold water.

Thus, in the water dispensing apparatus 10, such as the refrigerator or the water purifier, the user may submit one or more inputs to identify a desired amount of discharged water. However, adjustments of the water discharge parameters may be limited due to limitation of available key inputs on the water dispensing apparatus 10. In addition, in order to input a desired amount of discharged water, various key input may need to be performed several times.

The present disclosure provides a method of controlling a water dispensing apparatus, which is capable of easily and more accurately inputting a desired amount of discharged water through a voice recognition function to eliminate one or more key inputs.

Figure 4:
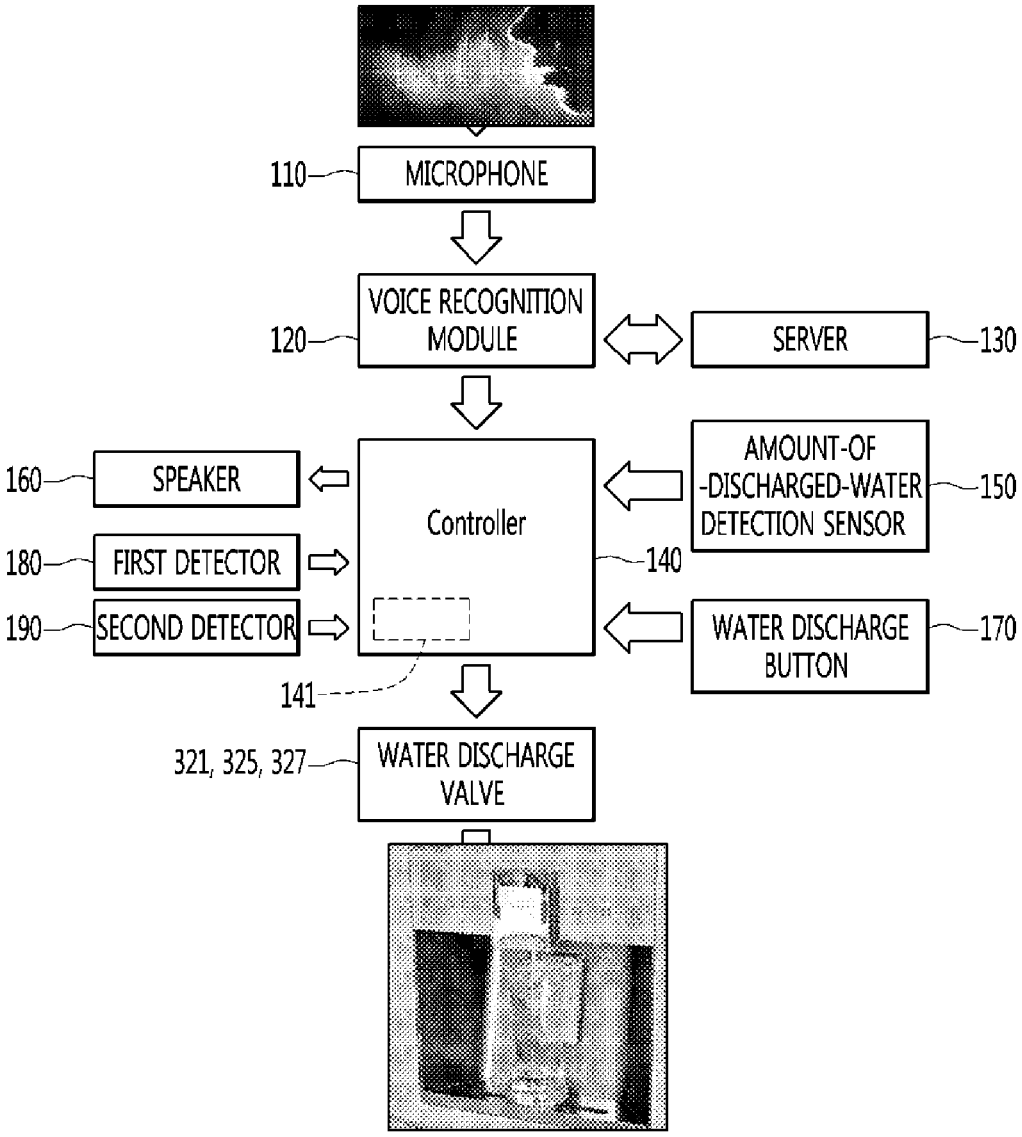
FIG. 4 is a block diagram showing some components of a water dispensing apparatus according to an embodiment of the present disclosure.
Figure 5:
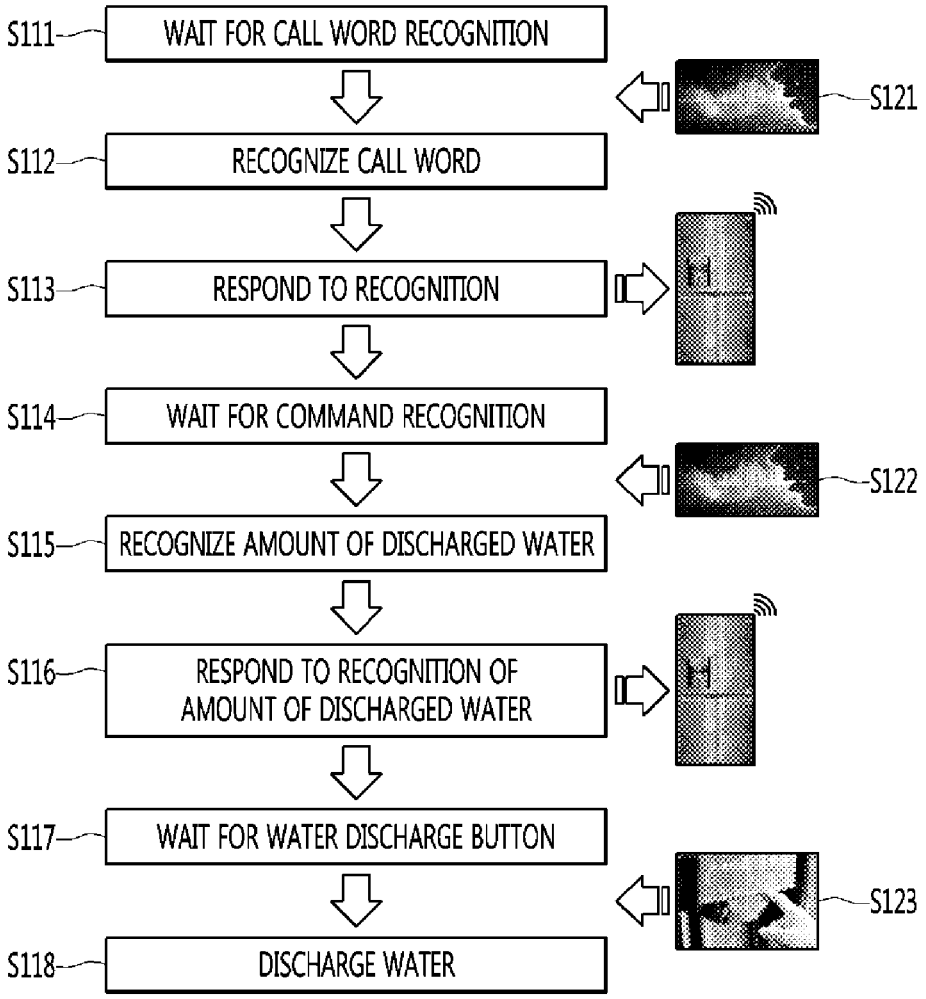
FIG. 5 is a flowchart illustrating a method of controlling a method of controlling a water dispensing apparatus according to an embodiment of the present disclosure.

FIG. 4 is a block diagram showing some components of a water dispensing apparatus 10 according to an embodiment of the present disclosure, and FIG. 5 is a flowchart illustrating a method of controlling a method of controlling a water dispensing apparatus 10 according to an embodiment of the present disclosure.

Referring to FIGS. 4 and 5, the water dispensing apparatus 10 according to an embodiment of the present disclosure may include a microphone 110 for receiving voice information uttered by a user, a voice recognition module 120 for recognizing voice information received through the microphone 110, a speaker 160 for outputting audio content such as guidance instruction to the user, a filter for filtering raw water, a water discharge nozzle for discharging the filtered water, water discharge valves 321, 325 and 327 for controlling whether water is discharged, a water amount sensor 150 for detecting the amount of the discharged water, a water discharge button 170 for receiving a water discharge command from the user, and a controller 140 for controlling opening and closing of the water discharge valve 321, 325, 327.

The method of controlling the water dispensing apparatus according to the present disclosure having the above-described configuration may control the amount of discharged water through voice commands that are received and processed by the water dispensing apparatus 10. Hereinafter, the method of controlling the water dispensing apparatus 10 according to an embodiment of the present disclosure will be described in detail.

The microphone 110 and the voice recognition module 120 may wait in a standby state for call word (or startup word) recognition (S111). For example, the microphone 110 may capture audio content constantly, intermittently, based on a receiving an input from the user, based on detecting an indication of speech by the user (e.g., the microphone 110 detects an increase in detected volume levels), etc. While the water dispensing apparatus 10 is in the standby state as described above such that the microphone 110 is recording audio, the user utters the call word by voice (speech act) (S121).

In addition, the call word of the voice type uttered by the user is input to the microphone 110 and/or the voice recognition module 120 for processing (S112). Here, the call word (or the startup word) input to the apparatus may be set to "Hi, LG", "Hi, Dios", "Hi, water purifier", "Hi, refrigerator", etc. The call word can be set to a prescribed term or may be set by the user, such as when the water dispensing device 10 is configured during an initial use. In one example, the voice recognition module 120 may compare the audio captured by the microphone to a stored recording of the user uttering the call word to determine whether the captured audio matches the stored recording.

Thereafter, the voice recognition module 120 responds to recognizing the input call (S113). For example, the voice recognition module 120 may evaluate audio content detected by the microphone 110, and may output a call word recognition guidance sound through the speaker based on detecting the call word. In one example, the "call word recognition guidance sound" output from the apparatus may be set to buzzer sound, machine sound" or may be audio content corresponding to guidance instructions (e.g., "Please tell me a desired command") or a greeting (e.g., "Hello" or "dispenser is active"). In another example, a non-audio response may be outputted, such as to activate and/or change a color of a light included in the water dispensing device 10.

In addition, after the call word recognition guidance sound is output, the microphone and the voice recognition module 170 may enter another standby state and wait for recognition of a command of a voice type uttered by the user (S114). Here, the command may correspond to "the desired amount of discharged water" or "the desired temperature of discharged water" of the user.

In the second standby state (S114), the user may utter audio content identifying the desired amount of discharged water (S122). For example, the user may utter a specific amount, such as "50 ml", "100 ml", "300 ml", etc. as the desired amount of discharged water. In another example, the user may utter a description of the specific amount, such as "large glass", "small cup", "favorite size", etc. that can be interpreted by the voice recognition module 170 based on stored logic and/or prior interactions with the user.

"The desired amount of discharged water" of the voice type uttered by the user may be detected by the microphone 110 and provided to the voice recognition module 120 (S115). For example, the audio identified the desired amount of audio can be compared to stored audio identifying different liquid amounts and the voice recognition module 120 one of the stored audio that is closest to the captured audio. Thereafter, the voice recognition module 120 recognizes "the desired amount of discharged water" input in step S115 and outputs amount-of-discharged-water recognition guidance sound through the speaker (S116). The "amount-of-discharged-water recognition guidance sound" output from the apparatus may be set to buzzer sound, machine sound or voice such as "Please press the water discharge button" or "Water ready to be discharged", or an indication of the amount to be discharged (e.g., "Water of 50 ml will be discharged"). In another example, a non-audio response may be outputted, such as to activate and/or to change a color of a light included in the water dispensing device 10.

Thereafter, the apparatus waits for water discharge button input from the user (S117). When the water dispensing apparatus 10 is in the third standby state associated with waiting for the water discharge button input (S117), the user presses the water discharge button 170 in order to trigger a discharge of water (S123) in the set amount. When the water discharge button is pressed, the water discharge valve 321, 325, 327 is opened to discharge water (S118). Similarly, when the amount of discharged water detected by the water amount sensor 311 corresponds to the desired amount of discharged water recognized in (S115), the water discharge valve 321, 325, 327 is closed to end water discharge.

Thus, according to this control method, by pressing the water discharge button 170 only once after the desired amount of discharged water is input by voice, it is possible to discharge the desired amount of water and, thus, to simplify operation of the apparatus 10. In addition, since it is possible to input the desired amount of discharged water through voice recognition, it is possible to solve the limit in setting of the amount of discharged water. For example, as previously described, instead of using an amount of discharged water that can only be set to 50 ml, 100 ml, etc., that is, is set in units of 50 ml, a different discharge amount may be set based on voice commands by a user. For example, when "75 ml" is input by voice, "75 ml" of water may be discharged. That is, the amount of discharged water may be set in smaller or larger units than the conventional preset amounts.

Furthermore, the unit of the amount of discharged water may be changed according to the water amount detection unit (resolution) of the water amount sensor. For example, when the water amount sensor 311 has an accuracy (e.g., resolution) of 3 ml, and the user identifies a desired discharge amount of 50 ml of water, the amount of discharged water may be actually discharged may be set to 48 ml or 51 ml, which are multiples of 3 and relatively close to 50 ml. For example, the set amount of discharged water may be set to 51 ml which is closest to 50 ml or may be set to 48 to be close but not greater than the desired amount of 50 ml (e.g., so that the water dispensing device 10 does not provide more than a desired amount to prevent overflowing a user's container). Thus, an amount of water corresponding to the amount of discharged water desired by the user may be supplied within a water detection resolution of the water amount sensor 311.

In addition, water is discharged only when last operation of the user is performed in a state in which the amount of discharged water is determined through voice recognition, thereby preventing water from being arbitrarily discharged before the user is ready to receive water (e.g., before the user inserts a glass to receive the water under the dispensing nozzle). Thus, it is possible to ensure water discharge safety, such as to prevent hot water for being dispensed before the user is prepared to receive the hot water.

Figure 6:
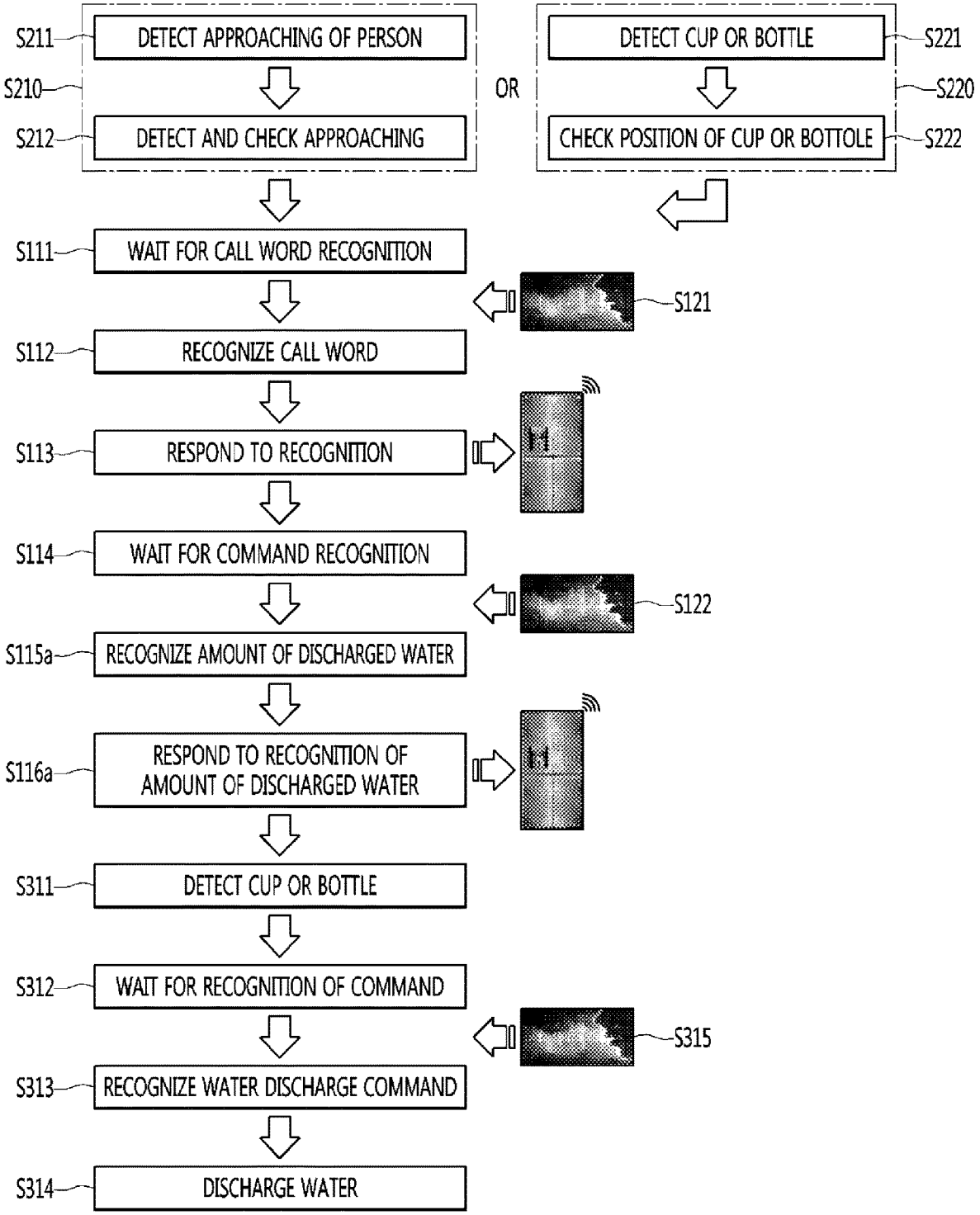
FIGS. 6 to 8 are flowcharts illustrating methods of controlling a method of controlling a water dispensing apparatus according to various embodiments of the present disclosure.
Figure 7:
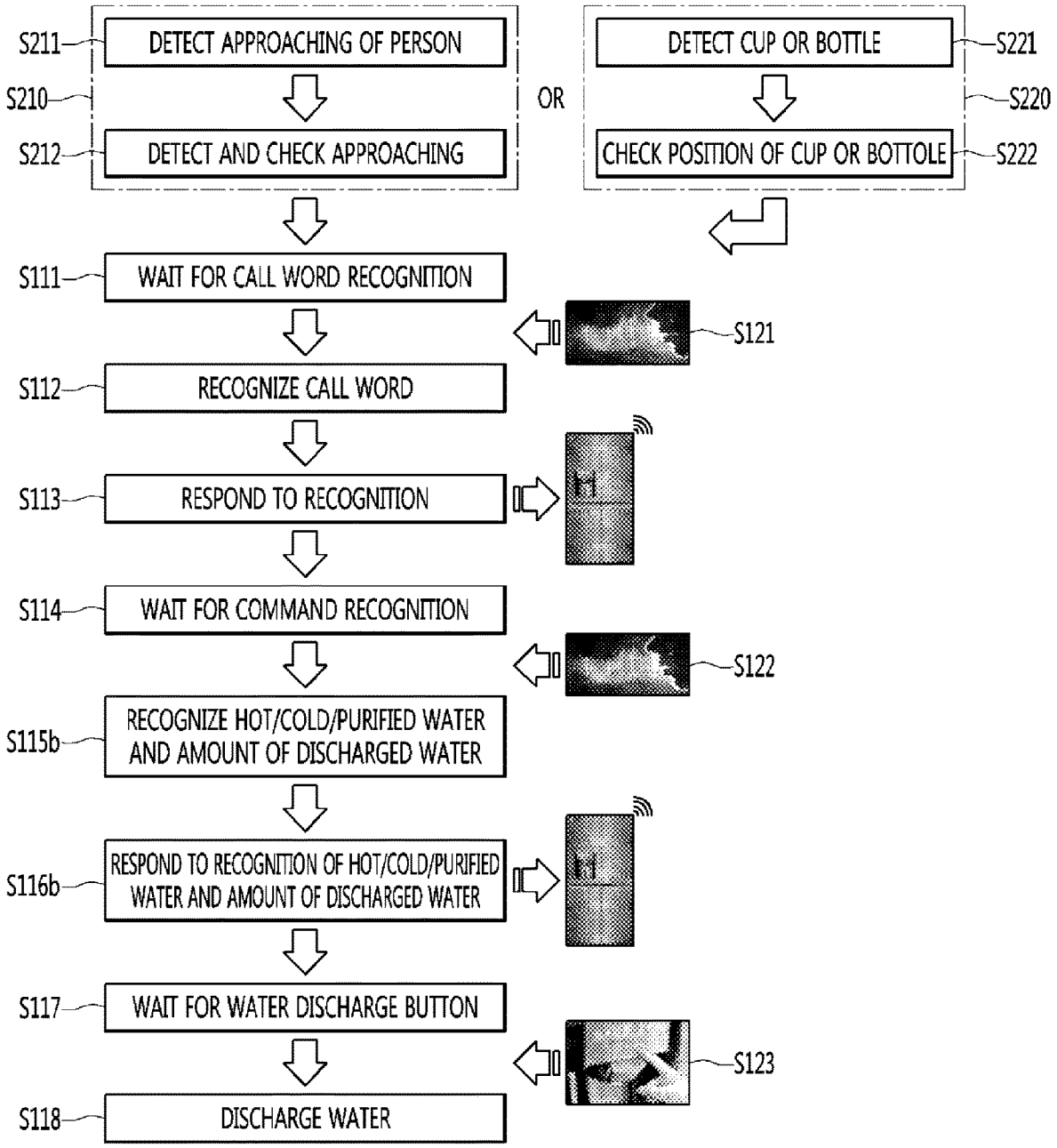
Figure 8:
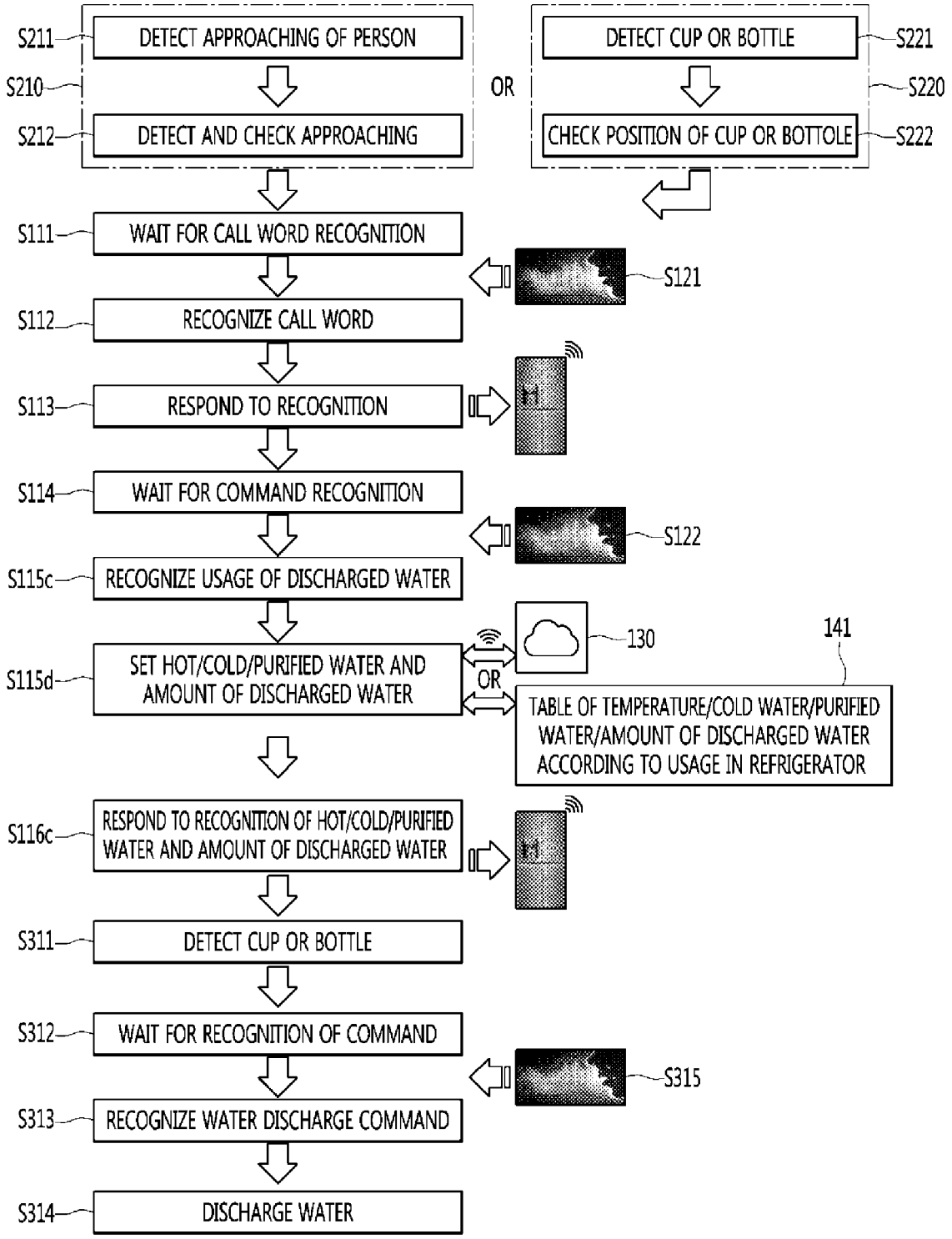

According to the present disclosure, it is possible to stably discharge water without the user pressing the water discharge button in other examples. FIGS. 6 to 8 are flowcharts illustrating methods of controlling a method of controlling a water dispensing apparatus according to various embodiments of the present disclosure.

Referring to FIG. 5 again, the water dispensing apparatus may further include a first detector (or container sensor) 180 for detecting a container such as a cup, a bottle, a pot or a bowl placed below the water discharge nozzle. In the present disclosure, it is possible to control the water dispensing apparatus such that the desired amount of water is discharged using the first detector 180 without pressing the water discharge button 170. For example, in one embodiment, the water discharge button 170 may be omitted. Hereinafter, the method of controlling the water dispensing apparatus 10 according to another embodiment of the present disclosure will be described with reference to FIG. 6.

First, the microphone and the voice recognition module wait for call word (or startup word) recognition (S111). In the standby state as described above, the user utters the call word by voice (S121). In addition, the call word of the voice type uttered by the user is input to the microphone and the voice recognition module (S112). As previously described, the call word (or the startup word) input to the apparatus may be set to "Hi, LG", "Hi, Dios", "Hi, water purifier", "Hi, refrigerator", etc.

Thereafter, the voice recognition module 120 recognizes the input call word and outputs call word recognition guidance sound through the speaker (S113). For example, the "call word recognition guidance sound" output from the apparatus may be set to buzzer sound, machine sound" or sound "Please tell me a desired command" or "Hello".

In addition, as described above, after the call word recognition guidance sound is output, the microphone and the voice recognition module wait for recognition of a "primary command" of a voice type uttered by the user (S114). Here, the primary command may correspond to "the desired amount of discharged water" or "the desired temperature of discharged water" of the user. In the standby state (S114), the user utters the desired amount of discharged water by voice (S122).

In addition, "the desired amount of discharged water" of the voice type uttered by the user is input to the microphone and the voice recognition module (S115*a*). For example, the user may utter "50 ml", "100 ml", "300 ml", etc. as the desired amount of discharged water or the user may provide a description of a drinking container to be filled by the water dispensing apparatus (e.g., small cup, large glass, etc.)

Thereafter, the voice recognition module recognizes "the desired amount of discharged water" and outputs amount-of-discharged-water recognition guidance sound through the speaker (S116*a*). The "amount-of-discharged-water recognition guidance sound" output from the apparatus may be set to buzzer sound, machine sound or voice such as "Please press the water discharge button" or "Water will be discharged", and/or an identification of the set amount of water (e.g., "Water of 50 ml will be discharged").

Thereafter, as described above, in a state of outputting the amount-of-discharged-water recognition guidance sound, the first detector 180 detects whether a container is placed below the water discharge nozzle (S311). For example, the first detector 180 may include an emitter to output light and a sensor to detect a reflection of the light when the container is placed below the water discharge nozzle 170. When the first detector detects the container placed below the water discharge nozzle, water may be immediately discharged (e.g., based on detecting the container by the first detector 180).

In another example, even when the first detector detects the container placed below the water discharge nozzle, water may not be immediately discharged and water may be discharged only when a user voice command is additionally received. To this end, after step S311, the microphone and the voice recognition module waits for recognition of a secondary command of a voice type uttered by the user (S312).

In the standby state as described above, the user utters the "secondary command" for instructing discharging of water by voice (S315). Here, the secondary command input to the apparatus may be set to "Please discharge water", "discharge water", "start" etc. In addition, the "water discharge command" of the voice type uttered by the user is detected by the microphone and input to the voice recognition module (S313).

As described above, when the voice water discharge command uttered by the user is input to the microphone, the water discharge valve is opened to discharge water (S314). Then, when the amount of discharged water detected by the water amount sensor reaches the desired amount of discharged water, the water discharge value 312, 325, 327 is closed to end water discharge.

Thus, according to aspects of the present disclosure, when the container placed below the water discharge nozzle is detected and the desired amount of discharged water is set according to a voice command, it is further possible to receive a vocal water discharge command based on an utterance by the user and to stably discharge water without the user operating the button.

In addition, water is discharged when the container placed below the water discharge nozzle is detected and the voice water discharge command is received from the user in a state in which the amount of discharged water is determined through voice recognition, thereby preventing water from being arbitrarily discharged when the user is not ready to receive water. That is, it is possible to secure water discharge safety.

Meanwhile, according to the present disclosure, in order to reduce standby power, the microphone and the voice recognition module may be maintained in the off mode in the standby state when not detecting audio associated with setting a water amount or activating a discharge of water. Referring to FIG. 6, the microphone 110 or the voice recognition module 120 may switch from an "off" mode to an "on" mode when the first detector 180 detects a container (S220). In the standby state, at least one of the microphone 110 or the voice recognition module 120 may be put in the off mode, and power is applied to the first detector 180 to detect presence of the container such as a cup or a bottle placed below the water discharge nozzle (S221).

In the off mode, the microphone or the voice recognition module does not recognize the call word uttered by the user. Thereafter, when the first detector 180 detects the container, whether the container is placed below the water discharge nozzle (S222). Upon determining that the container is placed below the water discharge nozzle, the microphone or the voice recognition module may be switched to the "on" mode capable of recognizing the voice call word. That is, the microphone or the voice recognition module is switched to a recognition standby state of the call word uttered by the user (S111). To this end, the first detector 180 may further include a sensor for detecting a container approaching the water discharge nozzle and a separate sensor for detecting the position of the container placed below the water discharge nozzle.

Referring to FIG. 4 again, the water dispensing apparatus may further include a second detector (or user sensor) 190 for detecting a human body approaching the periphery of the water discharge nozzle. Referring to FIG. 6, the microphone or the voice recognition module may be switched from the off mode to the on mode capable of recognizing a voice call word when the second detector 190 detects a presence of a user (S210).

Specifically, in the standby state, the microphone or the voice recognition module is in the off mode and power is applied to the second detector 190 to detect approaching of a person (S211). In the off mode, the microphone or the voice recognition module does not recognize the call word uttered by the user. Thereafter, as the user approaches the apparatus, the second detector 190 detects and checks a human body (S212).

The microphone or the voice recognition module is switched to the on mode capable of recognizing the voice call word and enters the recognition standby state of the call word uttered by the user (S111) based on the second sensor 190 detecting a presence of the user (e.g., that user is moving toward the dispensing device 10 and/or is located within a threshold distance of the dispensing device 10.

If the first detector 180 and the second detector 190 are not present, in order to recognize voice uttered by the user, the microphone and the voice recognition module may be always maintained in the on mode and, thus, power consumption may be increased. For reference, since a water dispensing apparatus 10 such a refrigerator or a water purifier is used to discharge water or ice unlike the other voice recognition products, the user carries a container near the apparatus in order to discharge water or ice. In addition, a container such as a cup is placed below the water discharge nozzle of the apparatus to receive the dispensed liquid.

In the present disclosure, power is controlled to be selectively supplied to the microphone or the voice recognition module only when or within a prescribed time period (e.g., 5 seconds) of detecting the user (human body) approaching the periphery of the water discharge nozzle of the apparatus or the container such as the cup placed below the water discharge nozzle, thereby selectively switching to a voice recognition "on" mode. Accordingly, it is possible to reduce the standby power of the apparatus and to improve power consumption. Thus, if a voice recognition function is applied to the home appliances, standby power for waiting for voice recognition is used, thereby increasing power consumption. However, in the present disclosure, by performing the voice recognition function only when water or ice is discharged, it is possible to reduce power consumption of the apparatus and to reduce power rates.

Meanwhile, according to the present disclosure, it is possible to control the temperature of discharged water. Referring to FIG. 7, after the call word recognition guidance sound is output through the speaker in step S113, when the user utters the desired amount of discharged water in step S122, a desired temperature of discharged water may be uttered and recognized by the water dispensing device 10, and the water dispensing device 10 may be controlled to provide the requested amount of liquid at the requested temperature. For example, the user may utter the desired temperature of discharged water along with the desired amount of discharged water in the form of "purified water of 50 ml", "10° C. water of 100 ml" or "200 ml of water at 90° C.". In another example, the user may provide a description of the desired temperature, such as "100 ml of hot water," "66 ml of chilled water", a "large glass of cold water", etc.

Thereafter, the desired temperature of discharged water uttered by the user along with the desired amount of discharged water is input to the voice recognition module through the microphone 110, and the voice recognition module 120 recognizes the desired temperature of discharged water along with the desired amount of discharged water (S115*b*). For example, the voice recognition module 120 compares the captures audio to stored audio data files associated with different temperatures, and may identify a temperature associated with a stored one of the audio data files that most closely matches the captured audio by the user.

As described above, when the voice recognition module recognizes 120 the desired amount of discharged water and the desired temperature of discharged water uttered by the user, the controller outputs the amount-of-discharged-water and desired-amount-of-discharged-water guidance sound through the speaker (S116*b*). In addition, when the user operates the water discharge button in step S123, the water discharge valve may be opened, thereby discharging water having a temperature desired by the user by the desired amount.

In addition, when the first detection sensor detects the container below the water discharge nozzle in step S311 (see FIG. 6) and the user utters a voice water discharge command in step S315 (see FIG. 6), the water discharge valve may be opened, thereby discharging water having a temperature desired by the user by the desired amount. In addition, when the amount of discharged water detected by the water amount sensor reaches the desired amount of discharged water, the water discharge value is closed, thereby ending water discharge.

In one implementation, the water dispensing apparatus 10 according to the present disclosure may further include a hot water generation module (e.g., water tank 780 and heater 710) for heating water passing through the filter and supplying hot water to the water discharge nozzle and/or a cold water generation module for cooling water passing through the filter to supply cold water to the water discharge nozzle.

For example, when the user instructs discharging of "purified water of 300 ml" by voice, the water passing through the filter may be discharged through the water discharge nozzle without passing through the hot water generation module or the cold water generation module. For example, the water dispensing apparatus 10 can selectively activate various valves to activate purified water passage 331 and to bypass the cold water passage 341 and the hot water passage 770.

In another example, when the user instructs discharging of "hot water of 200 ml" by voice, the water passing through the filter may be heated through the hot water generation module and discharged through the water discharge nozzle. For example, the water dispensing apparatus 10 can direct water through the hot water passage 770. At this time, the hot water generation module may generate hot water using an instantaneous heater (IH) method using inductive heating.

In another example, when the user instructs discharging of "cold water of 500 ml" by voice, the water passing through the filter may be cooled through the cold water generation module and discharged through the water discharge nozzle. For example, the water dispensing apparatus 10 can selectively activate various valves to direct water through the cold water passage 341.

In addition, according to the present disclosure, ice may be discharged through voice. To this end, the water dispensing apparatus 10 according to the present disclosure may further include an ice maker 251 for receiving water, making ice, and storing the ice, and a mechanism, such as a rotating ice dispenser, for controlling whether ice is discharged. In addition, when call word recognition guidance sound is output through the speaker in step S113, the user may utter an ice discharge request along with the desired amount of discharged water or utter only the ice discharge request in step S122. For example, the user may utter ice discharge and/or the desired amount of discharged water such as "ice" "10 ice cubes", "only ice", or purified water of 100 ml with ice". In another example, the user may utter an amount and a type of ice to be dispensed, such as "50 ml of ice cubes" or "125 ml of crushed ice".

Thereafter, when the user operates the ice discharge button in step S123, the valve may be opened to discharge ice and/or water. In addition, when the user utters a voice water discharge command in step S315 (see FIG. 6) in a state in which the first detection sensor detects the container placed below the water discharge nozzle in step S311 (see FIG. 6), the valve may be opened to discharge ice and/or water. Meanwhile, in the present disclosure, when the user provides oral inputs identifying an intended usage of discharged water, water suiting the purpose may be discharged. Referring to FIG. 4 again, a table 141 in which the usage of discharged water uttered by the user matches the amount and temperature of discharged water may be stored in or otherwise access by the controller 140. In another example, a table 141 in which the usage of discharged water uttered by the user matches the amount and temperature of discharged water may be stored in the server (or computer) 130 communicating with the controller through Wi-Fi.

Referring to FIG. 8, after a call word recognition guidance sound is outputted through the speaker in step S113, the user may utter desired usage of discharge water in step S114. For example, the user may utter the desired usage of discharged water in the form of "make instant ramen", "a cup of mixed coffee", or "one glass of cold water". When the user utters the desired usage of discharged water, the voice recognition module 120 may recognize the desired usage of discharged water (S115*c*). For example, the voice recognition module 120 may perform a speech to text processing of the received usage audio instructions. The controller 140 may compare the desired usage of discharged water recognized by the voice recognition module 120 with the table stored in the controller or the server 130 and checks and reads the amount and temperature of discharged water matching the desired usage of discharged water uttered by the user.

Usage-of-discharged-water guidance sound is output through the speaker (S116*c*). For example, the speaker 160 may output an indication that the water dispensing device 10 is ready to provide water for the indicated purpose. Thereafter, when the user operates the water discharge button in step S123, the valve may be opened to discharge water having a temperature suiting the desired usage of discharged water by the determined amount.

Alternatively, the user may provide an audio request to initiate the discharge of water, as previously described. For example, when the user utters a voice water discharge command in step S315 in a state in which the first detection sensor detects the container placed below the water discharge nozzle in step S311, one or more of the valves may be opened to discharge water having a temperature suiting the desired usage of discharged water by the determined amount.

For example, when the user utters "one cup of ramen" as the desired usage of discharged water and the voice recognition module recognizes the desired usage of discharged water, the controller compares the desired usage of discharged water with the table stored in the table or the server 130 and reads the temperature and amount of discharged water for one cup of ramen. For example, the temperature of water for one cup of ramen stored in the table may be 95° C. and the amount of discharged water may be 250 ml.

Thereafter, when the user operates the water discharge button in step S123 (see FIG. 7), the water discharge values 321, 325 and 327 are opened to discharge water of 250 ml at 95° C. (hot water).

When the user utters a voice water discharge command in step S315 in a state in which the first detection sensor detects the container placed below the water discharge nozzle in step S311, the water discharge values 321, 325 and 327 are opened to discharge the requested amount and temperature of water, such as to discharge water of 250 ml at 95° C. (hot water) for making a package of instant ramen. In addition, when the amount of discharged water detected by the water amount sensor reaches the desired amount of discharged water, the water discharge value is closed, thereby ending water discharge.

In a water dispensing apparatus having a general voice recognition water discharge function, voice may be mistakenly recognized and undesired water may be discharged. In this case, the floor and the periphery of the product may be messed up or hot water may be discharged in a state in which a cup or bottle is not prepared. In contrast, in the present disclosure, after the desired temperature and amount of water is determined through voice recognition, water is discharged only when the user is ready to receive water, thereby preventing water from being mistakenly discharged. For example, water may be discharged only when the user directly press the water discharge button after preparation for water discharge is completed.

In another example, water may be discharged only when the user directly utters a vocal water discharge command after a cup or a bottle is placed below the water discharge nozzle. Therefore, it is possible to prevent discharge from being discharged due to mistaken voice recognition and to prevent accidents.

An aspect of the present disclosure provides a method of controlling a water dispensing apparatus to be capable of simplifying operation of the apparatus, by inputting a desired amount of discharged water by voice and pressing a water discharge button only once to discharge the desired amount of water. Another aspect of the present disclosure provides a method of controlling a water dispensing apparatus, which is capable of solving a limit in setting of the amount of discharged water by inputting a desired amount of discharged water by voice through voice recognition.

Another aspect of the present disclosure provides a method of controlling a water dispensing apparatus, which is capable of preventing water from being arbitrarily discharged in a state in which a user is not ready to receive water, that is, capable of ensuring water discharge safety, by discharging water only when last user operation is performed in a state in which the amount of discharged water is determined through voice recognition.

Another aspect of the present disclosure provides a method of controlling a water dispensing apparatus, which is capable of inputting a water discharge command by voice to discharge water without operating a button when a container placed below a water discharge nozzle is detected in a state of inputting a desired amount of discharged water by voice.

Another aspect of the present disclosure provides a method of controlling a water dispensing apparatus, which is capable of preventing water from being arbitrarily discharged in a state in which a user is not ready to receive water, that is, capable of ensuring water discharge safety, by detecting a container placed below a water discharge nozzle in a state of determining the amount of discharged water through voice recognition and discharging water only in a state of receiving a voice water discharge command from a user.

Another aspect of the present disclosure provides a method of controlling a water dispensing apparatus, which is capable of reducing standby power of the apparatus and improving power consumption, by controlling a microphone or a voice recognition module to be switched to an on mode only in a state of detecting a user approaching the periphery of the water discharge nozzle of the apparatus or a container such as a cup placed below the water discharge nozzle. Another aspect of the present disclosure provides a method of controlling a water dispensing apparatus, which is capable of discharging a desired amount of water without pressing a water discharge button.

In one embodiment, a water dispensing apparatus includes a microphone for receiving voice uttered by a user, a voice recognition module for recognizing voice information input through the microphone, a speaker for outputting guidance sound to the user, a filter for filtering raw water, a water discharge nozzle for discharging the filtered water, a water discharge valve for controlling whether water is discharged, a water amount sensor for detecting the amount of the discharged water, a water discharge button for receiving a water discharge command from a user and a controller for controlling opening and closing of the water discharge valve.

In addition, a method of controlling a water dispensing apparatus includes receiving a call word of a voice type uttered by the user through the microphone, recognizing the received call word through the voice recognition module and outputting call word recognition guidance sound through the speaker, receiving a desired amount of discharged water of a voice type uttered by the user through the microphone, recognizing the received desired amount of discharged water through the voice recognition module and outputting amount-of-discharged-water recognition guidance sound through the speaker, the user operating the water discharge button to input a water discharge command, opening the water discharge valve to discharge water, and closing the water discharge valve to end water discharge when the amount of the discharged water detected by the water amount sensor reaches the received desired amount of discharged water.

The water dispensing apparatus may further include a first detector for detecting a container disposed below the water discharge nozzle. The microphone or the voice recognition module may be switched from an off mode to an on mode capable of recognizing a voice call word when the first detector detects the container.

The water dispensing apparatus may further include a second detector for detecting a human body approaching the periphery of the water discharge nozzle. The microphone or the voice recognition module may be switched from an off mode to an on mode capable of recognizing a voice call word when the second detector detects the human body.

After the call word recognition guidance sound is output through the speaker, when a desired discharged water temperature is received through the microphone along with the desired amount of discharged water uttered by the user, the received desired amount of discharged water and the desired discharged water temperature may be recognized through the voice recognition module and the amount-of-discharged-water and discharged-water-temperature recognition guidance sound may be output through the speaker.

The water dispensing apparatus may further include a hot water generation module for heating the water passing through the filter and supplying hot water to the water discharge nozzle and a cold water generation module for cooling water passing through the filter and supplying cold water to the water discharge nozzle, and, when the user operates the water discharge button, the water discharge valve may be opened to discharge water having the received desired discharged water temperature.

The controller may store matching information of usage of discharged water uttered by the user, and an amount of discharged water and a discharged water temperature corresponding thereto. When desired usage of discharged water of a voice type uttered by the user is received through the microphone, the received desired usage of discharged water may be recognized through the voice recognition module and usage-of-discharged-water recognition guidance sound may be output through the speaker. When the user operates the water discharge button, the water discharge valve may be opened to discharge water having a discharged water temperature matching the received desired usage of discharged water by the matched amount of discharged water.

In another aspect, a water dispensing apparatus includes a microphone for receiving voice uttered by a user, a voice recognition module for recognizing voice information input through the microphone, a speaker for outputting guidance sound to the user, a filter for filtering raw water, a water discharge nozzle for discharging the filtered water, a water discharge valve for controlling whether water is discharged, a water amount sensor for detecting the amount of the discharged water, a first detector for detecting a container disposed below the water discharge nozzle, and a controller for controlling opening and closing of the water discharge valve.

A method of a water dispensing apparatus includes receiving a call word of a voice type uttered by the user through the microphone, recognizing the received call word through the voice recognition module and outputting call word recognition guidance sound through the speaker, receiving a desired amount of discharged water of a voice type uttered by the user through the microphone, recognizing the received desired amount of discharged water through the voice recognition module and outputting amount-of-discharged-water recognition guidance sound through the speaker, detecting whether the container is disposed below the water discharge nozzle through the first detector, opening the water discharge valve to discharge water when the first detector detects the container, and closing the water discharge valve to end water discharge when the amount of the discharged water detected by the water amount sensor reaches the received desired amount of discharged water.

When a voice water discharge command uttered by the user is received through the microphone in a state in which the first detector detects the container disposed below the water discharge nozzle, the water discharge valve may be opened to discharge water. The microphone or the voice recognition module may be switched from an off mode to an on mode capable of recognizing a voice call word when the first detector detects the container.

The water dispensing apparatus may further include a second detector for detecting a human body approaching the periphery of the water discharge nozzle, and the microphone or the voice recognition module may be switched from an off mode to an on mode capable of recognizing a voice call word when the second detector detects the human body.

After the call word recognition guidance sound is output through the speaker, when a desired discharged water temperature is received through the microphone along with the desired amount of discharged water uttered by the user, the received desired amount of discharged water and the desired discharged water temperature may be recognized through the voice recognition module and the amount-of-discharged-water and discharged-water-temperature recognition guidance sound may be output through the speaker.

The water dispensing apparatus may further include a hot water module for heating the water passing through the filter and supplying hot water to the water discharge nozzle and a cold water module for cooling water passing through the filter and supplying cold water to the water discharge nozzle. When the water discharge valve is opened, water having the received desired discharged water temperature may be discharged.

The controller may store matching information of usage of discharged water uttered by the user, and an amount of discharged water and a discharged water temperature corresponding thereto. When desired usage of discharged water of a voice type uttered by the user is received through the microphone, the received desired usage of discharged water may be recognized through the voice recognition module and usage-of-discharged-water recognition guidance sound may be output through the speaker. When the water discharge valve is opened, water having a discharged water temperature matching the received desired usage of discharged water may be discharged by the matched amount of discharged water.

According to the present disclosure, it is possible to simplify operation of the apparatus, by inputting a desired amount of discharged water by voice and pressing a water discharge button only once to discharge the desired amount of water. In addition, it is possible to solve a limit in setting of the amount of discharged water by inputting a desired amount of discharged water by voice through voice recognition. In addition, it is possible to prevent water from being arbitrarily discharged in a state in which a user is not ready to receive water, that is, to ensure water discharge safety, by discharging water only when last user operation is performed in a state in which the amount of discharged water is determined through voice recognition.

In addition, it is possible to input a water discharge command by voice to discharge water without operating a button when a container placed below a water discharge nozzle is detected in a state of inputting a desired amount of discharged water by voice. In addition, it is possible to prevent water from being arbitrarily discharged in a state in which a user is not ready to receive water, that is, to ensure water discharge safety, by detecting a container placed below a water discharge nozzle in a state of determining the amount of discharged water through voice recognition and discharging water only in a state of receiving a voice water discharge command from a user.

In addition, it is possible to reduce standby power of the apparatus and improve power consumption, by controlling a microphone or a voice recognition module to be switched to an on mode only in a state of detecting a user approaching the periphery of the water discharge nozzle of the apparatus or a container such as a cup placed below the water discharge nozzle. In addition, it is possible to discharge a desired amount of water without pressing a water discharge button.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid dispensing apparatus comprising:

a microphone into which voice information uttered by a user is input;

a voice recognition module configured to recognize the voice information input into the microphone;

a speaker configured to output guidance sound to the user;

a liquid discharge nozzle configured to discharge liquid;

a liquid discharge valve to control a flow of liquid flowing to the liquid discharge nozzle for liquid discharge;

a controller configured to, when desired liquid discharge information is included in the voice information uttered by the user and input to the microphone, output a desired liquid discharge information recognition guidance sound through the speaker, and then to open the liquid discharge valve so that liquid is discharged based on the desired liquid discharge information; and at least one of a first detection unit configured to detect when a container is positioned under the liquid discharge nozzle, or a second detection unit configured to detect when a human body is approaching the liquid discharge nozzle, wherein, when the at least one of the first detection unit detects the container or the second detection unit detects the human body approaching the liquid discharge nozzle, at least one of the microphone or the voice recognition module is switched from an inactivated state to an activated state to be capable of recognizing a voice.

2. The liquid dispensing apparatus of claim 1, wherein when a call word in the voice form uttered by the user is input into the microphone, the input call word is recognized in the voice recognition module, and wherein the controller outputs a call word recognition guidance sound through the speaker.

3. The liquid dispensing apparatus of claim 1, further comprising:

a filter configured to filter liquid introduced from outside of the liquid dispensing apparatus and then to discharge the filtered liquid toward the liquid discharge nozzle.

4. The liquid dispensing apparatus of claim 1, further comprising:

a liquid discharge operation button configured to receive a liquid discharge command from the user.

5. The liquid dispensing apparatus of claim 4, wherein the controller outputs a desired liquid discharge information recognition guidance sound through the speaker and then opens the liquid discharge valve when the liquid discharge command is input through the liquid discharge operation button.

6. The liquid dispensing apparatus of claim 1, wherein the controller controls the liquid discharge valve to be closed after liquid is discharged based on the input desired liquid discharge information.

7. The liquid dispensing apparatus of claim 1, wherein the desired liquid discharge information uttered by the user includes information on at least one of a desired liquid discharge amount or a desired liquid discharge temperature.

8. The liquid dispensing apparatus of claim 7, further comprising:

a flow sensor configured to detecting a flow rate of the liquid discharged through the liquid discharge valve, wherein the controller controls the liquid discharge valve to be closed when the flow rate detected by the flow sensor indicates that an amount of discharged liquid reaches the desired liquid discharge amount included in the desired liquid discharge information.

9. The liquid dispensing apparatus of claim 7, wherein, when the at least one of the desired liquid discharge amount or the desired liquid discharge temperature uttered by the user is input into the microphone, the voice recognition module recognizes the at least one of the input desired liquid discharge amount or desired liquid discharge temperature, and a liquid discharge amount or liquid discharge temperature recognition guidance sound is output through the speaker.

10. The liquid dispensing apparatus of claim 7, further comprising:

at least one of a hot liquid generation module that heats liquid and supplies the heated liquid to the liquid discharge nozzle or a cold liquid generation module that cools liquid and supplies the cooled liquid to the liquid discharge nozzle, wherein, when the user inputs a liquid discharge command while the liquid discharge valve is opened, respective amounts of at least one of the heated liquid or the cooled liquid is discharged such that liquid having the desired liquid discharge temperature is discharged.

11. The liquid dispensing apparatus of claim 10, wherein the desired liquid discharge information uttered by the user includes a desired liquid discharge use, and wherein information to match the liquid discharge use uttered by the user with at least one of the liquid discharge amount or the liquid discharge temperature is determined by the controller.

12. The liquid dispensing apparatus of claim 11, wherein, when the desired liquid discharge use in voice form uttered by the user is input into the microphone, the voice recognition module recognizes the input desired liquid discharge use, and a liquid discharge use recognition guidance sound is output through the speaker.

13. The liquid dispensing apparatus of claim 10, wherein the desired liquid discharge information uttered by the user includes a desired liquid discharge use, and wherein the controller communicates with a server in which information to match the liquid discharge use uttered by the user, and the at least one of the liquid discharge amount or the liquid discharge temperature is stored.

14. The liquid dispensing apparatus of claim 13, wherein, when the desired liquid discharge use of voice form uttered by the user is input into the microphone, the voice recognition module recognizes the input desired liquid discharge use, and a liquid discharge use recognition guidance sound is output through the speaker.

15. The liquid dispensing apparatus of claim 11, wherein when the user inputs a liquid discharge command while the liquid discharge valve is opened, liquid having a liquid discharge temperature corresponding to the desired liquid discharge use is discharged in the liquid discharge amount corresponding to the desired liquid discharge use.

16. The liquid dispensing apparatus of claim 15, wherein the user inputs a liquid discharge command by voice, and wherein the controller opens the liquid discharge valve when the user inputs the liquid discharge command by voice.

17. The liquid dispensing apparatus of claim 15, wherein the user enters a liquid discharge command through a liquid discharge operating button provided separately, and wherein the controller opens the liquid discharge valve when the liquid discharge command is input through the liquid discharge operating button.

18. The liquid dispensing apparatus of claim 1, wherein the liquid dispensing device includes a refrigerator or a water purifier.

19. The liquid dispensing apparatus of claim 1, wherein the liquid dispensing apparatus comprises the first detection unit to detect when the container is positioned under the liquid discharge nozzle and the second detection unit to detect when the human body is approaching the liquid discharge nozzle, and wherein, when both the first detection unit detects the container and the second detection unit detects the human body approaching the liquid discharge nozzle, at least one of the microphone or the voice recognition module is switched from the inactivate state to the activated state.

20. The liquid dispensing apparatus of claim 1, wherein the at least one of the microphone or the voice recognition module is in the activated state during a prescribed time period after the first detection unit detects the container or the second detection unit detects the human body approaching the liquid discharge nozzle and then is switched from the activated state to the inactivate state.

* * * * *